US008983079B2

(12) United States Patent
Okita et al.

(10) Patent No.: US 8,983,079 B2
(45) Date of Patent: Mar. 17, 2015

(54) STEREO MICROPHONE

(75) Inventors: Shioto Okita, Kanagawa (JP); Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 426 days.

(21) Appl. No.: 13/464,184

(22) Filed: May 4, 2012

(65) Prior Publication Data

US 2012/0288101 A1 Nov. 15, 2012

(30) Foreign Application Priority Data

May 13, 2011 (JP) ..... 2011-108024

(51) Int. Cl.

| | |
|---|---|
| ***H04R 5/00*** | (2006.01) |
| ***H04R 3/00*** | (2006.01) |
| ***H04R 5/027*** | (2006.01) |
| *H04R 1/40* | (2006.01) |
| *H04R 19/04* | (2006.01) |

(52) U.S. Cl.

CPC ..... *H04R 5/027* (2013.01); *H04R 1/406* (2013.01); *H04R 19/04* (2013.01)

USPC ..... 381/26; 381/92

(58) Field of Classification Search

CPC ..... H04R 3/00; H04R 5/00; H04R 1/02

USPC ..... 381/91–92, 26, 122

See application file for complete search history.

(56) References Cited

U.S. PATENT DOCUMENTS

| | | | | |
|---|---|---|---|---|
| 4,262,170 | A | 4/1981 | Bauer | |
| 4,414,433 | A * | 11/1983 | Horie et al. | 381/92 |
| 4,757,545 | A * | 7/1988 | Rosander | 381/92 |
| 8,526,625 | B2 * | 9/2013 | Akino | 381/26 |
| 8,559,657 | B2 * | 10/2013 | Akino et al. | 381/111 |
| 2006/0222187 | A1 * | 10/2006 | Jarrett et al. | 381/92 |

FOREIGN PATENT DOCUMENTS

| | | |
|---|---|---|
| JP | S55143089 A | 11/1980 |
| JP | 6-303691 | 10/1994 |
| JP | 2011-087123 | 4/2011 |

* cited by examiner

*Primary Examiner* — Disler Paul

(74) *Attorney, Agent, or Firm* — Whitham Curtis Christofferson & Cook, PC

(57) ABSTRACT

A stereo microphone has four condenser microphone units having respective directional axes in the same horizontal plane. The four units each have unidirectivity and a quadrangular shape viewed from the direction of the directional axis. The units are disposed by rotating the directional axes of adjacent units by 90°. A pair of two units diagonally positioned and having the directional axes directed at 180° to each other collaborate with each other to form a pair of bidirectional microphone units.

4 Claims, 5 Drawing Sheets

STEREO MICROPHONE

BACKGROUND OF THE INVENTION

1. Field of the Invention

The present invention relates to a stereo microphone having stable directional frequency response in a high-frequency range without generation of intrinsic noise.

2. Related Background Art

As disclosed in Japanese Unexamined Patent Application Publication No. H06-303691, a stereo microphone includes two microphone units, which output signals from left and right channels respectively.

Such a stereo microphone has, for example, two bidirectional microphone units, one of which has a directional axis directed at an angle of −45° to the left relative to the front of the microphone and the other has a directional axis directed at an angle of +45° to the right. The stereo microphone employs a Blumlein array for sound collection. The bidirectional microphone units configuring the Blumlein array include electrostatic condenser microphone units and electrodynamic ribbon microphone units.

The two microphone units included in the stereo microphone are generally disposed such that their directional axes are provided in the same horizontal plane. For the bidirectional microphone units used in the Blumlein array, however, it is not preferred in view of the performance that the left and right channel units be adjacently disposed since the properties are adversely affected unless a proximate construction is designed front/back symmetrically relative to the sound center. Thus, the two bidirectional units of the Blumlein stereo microphone are vertically stacked.

In such a Blumlein stereo microphone, the directional axes of the two microphone units are present in different horizontal planes, which configuration is not preferred for stereo sound collection. Since the directional axes of the two vertically stacked microphone units do not reside in the same horizontal plane, vertical (upper and lower) imbalance of a sound source relative to a proximate sound source, in particular, is picked up separately in the upper and lower microphone units, thus resulting in horizontally (left and right) unbalanced output.

It is thus desired for the stereo microphone to have compatibility between prevention of impact on acoustic properties due to a proximate construction and satisfactory stereo sound collection by disposing microphone units in the same plane.

The Blumlein stereo microphone may include bidirectional condenser microphone units. The bidirectional microphone units each have sound terminals in the front and back. A diaphragm vibrates in response to a sound pressure gradient determined by the distance between the front and back sound terminals. In order to achieve desired sensitivity, it is necessary to easily generate the sound pressure gradient, thus requiring a certain distance between the sound terminals. A long distance between the sound terminals, however, lowers a high-frequency sound collection limit.

In the case of using the bidirectional condenser microphone units, each of which generally includes a circular diaphragm, a large diameter of the unit is required for higher sensitivity.

One method of stereo sound collection is to combine two unidirectional condenser microphone units at a 180° direction to each other such that output sound signals are subtracted to achieve bidirectivity. Disposing the bidirectional sound collection axes configured as above in the same horizontal plane can solve the problem caused by vertical arrangement of the bidirectional microphone units described above, thus allowing stereo sound collection similar to the case of using the bidirectional condenser microphone units.

A similar configuration is provided in a four-channel one-point pickup microphone. Such a stereo microphone includes four unidirectional condenser microphone units disposed at different directions by 90° in the horizontal plane and back sound terminals sonically combined. Subtracting sound signals of the two unidirectional condenser microphone units disposed in the 180° direction provides bidirectivity.

Since the back sound terminals of the two unidirectional condenser microphone units disposed in the 180° direction are sonically combined, the distance between the sound terminals is inevitably long. Such a long distance between the sound terminals lowers the high-frequency sound collection limit, similar to the case of using the two bidirectional condenser microphone units described above.

With reference to FIGS. 4A to 4C, in a layout, four circular unidirectional condenser microphone units 10*a*, 10*b*, 10*c*, and 10*d* are disposed in the same horizontal plane such that external diameter portions thereof are in contact with each other by rotating directional axes of adjacent condenser microphone units 10 by 90°. A microphone having such a unit layout is referred to as a "four-channel one-point microphone," which collects sounds from four directions and converts the sounds separately into sound signals for output.

In the unit layout shown in FIGS. 4A to 4C, collaboration of the two diagonally-positioned condenser microphone units 10*a* and 10*c* or 10*b* and 10*d*, each having directional axes disposed at 180° to each other, provides a pair of bidirectional microphone units. The two pairs of bidirectional microphone units are disposed such that the directional axes are disposed at 90° to each other, and thereby a stereo microphone is provided.

In this case, a distance W2 between sound terminals of the pair of microphone units is defined by the diameter of each of the condenser microphone units 10. In the condenser microphone unit, as the effective capacitance increases between a diaphragm 101 and a fixed electrode 102, the sensitivity increases while the effective noise decreases. In order to increase the effective capacitance, it is necessary to increase the area S2 of the diaphragm 101 of the condenser microphone unit 10.

In order to increase the area S2 of the diaphragm 101 of the condenser microphone unit 10, it is necessary to increase the diameters of the diaphragm 101 and the condenser microphone unit 10. The increased diameters thereof, however, lead to a large distance W2 between the sound terminals of the pair of microphone units, thus reducing the high-frequency sound collection limit, as shown in FIG. 5.

SUMMARY OF THE INVENTION

In view of the circumstances above, an object of the present invention is to provide a stereo microphone having stable directional frequency response in a high-frequency range without generation of intrinsic noise by maintaining a short distance between sound terminals even with an increase in diaphragm size.

A main aspect of the present invention provides a stereo microphone including four condenser microphone units having directional axes disposed in a single horizontal plane, the condenser microphone units each having unidirectivity, the condenser microphone units each having a quadrangular shape viewed from a direction of each directional axis, the condenser microphone units being disposed such that adjacent condenser microphone units have directional axes directed in different directions by 90° from one another, two of the condenser microphone units diagonally positioned and having the directional axes directed at 180° to each other collaborating with each other to form a pair of bidirectional microphone units. The two pairs of bidirectional microphone units are disposed such that two directional axes of the pairs are disposed at 90° to each other.

DESCRIPTION OF THE PREFERRED EMBODIMENTS

Figure 1:
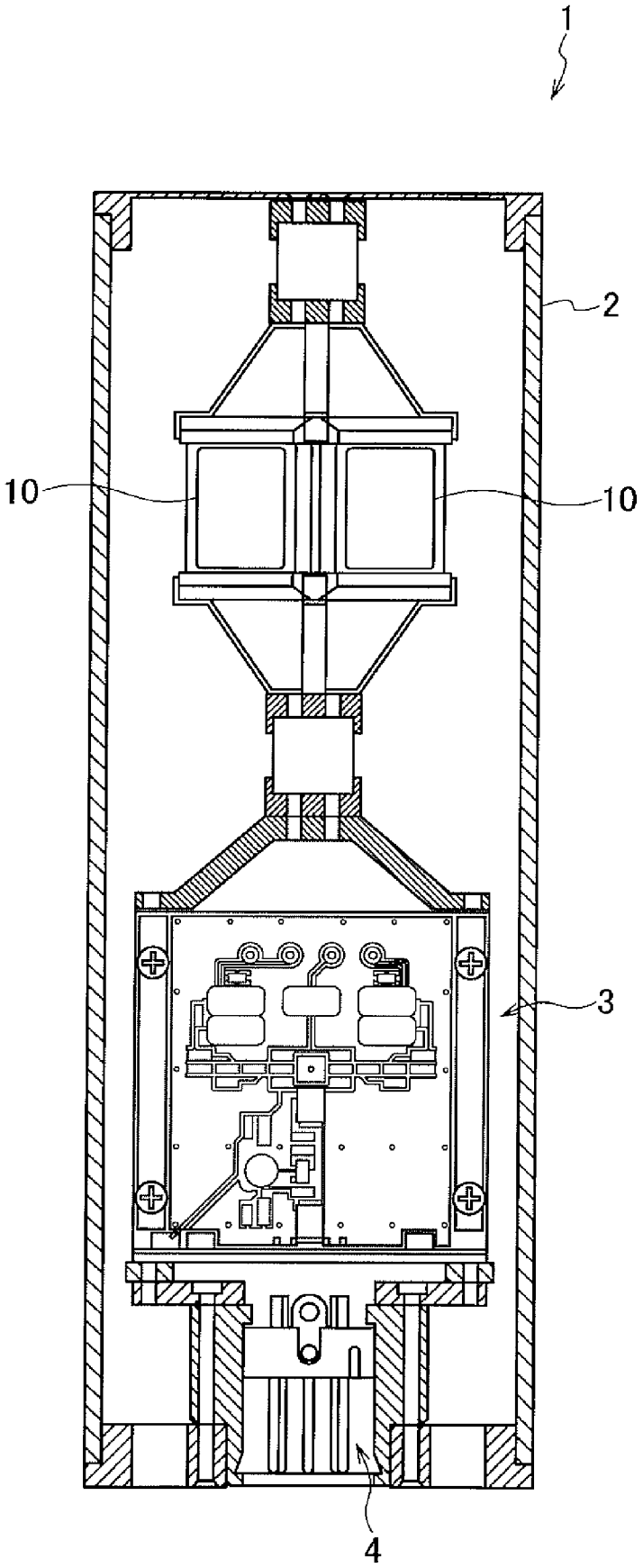
FIG. 1 is a partial cross-sectional front view illustrating a stereo microphone according to an embodiment of the present invention.

A stereo microphone according to an embodiment of the present invention is described with reference to FIGS. 1 to 3. Configurations the same as those in a conventional stereo microphone shown in FIGS. 4A to 4C are denoted with the same reference numerals.

With reference to FIG. 1, a stereo microphone 1 according to the embodiment of the present invention has a microphone casing 2 that accommodates four unidirectional condenser microphone units 10*a*, 10*b*, 10*c*, and 10*d* each having a substantially square shape in a plan view such that directional axes of the microphone units are disposed in the same horizontal plane. External sound reaches the condenser microphone units 10*a*, 10*b*, 10*c*, and 10*d* through a shield mesh (not shown in the drawing) provided in the microphone casing 2.

The microphone casing 2 includes a circuit board 3 on which electronic components, including a step-up transformer, are mounted. The output from the condenser microphone units 10*a*, 10*b*, 10*c*, and 10*d* passes through an output transformer so as to be supplied to an external device through a three-pin connector 4. The three-pin connector 4 includes hot and cold terminals of the output transformer and a ground terminal.

Figure 2C:
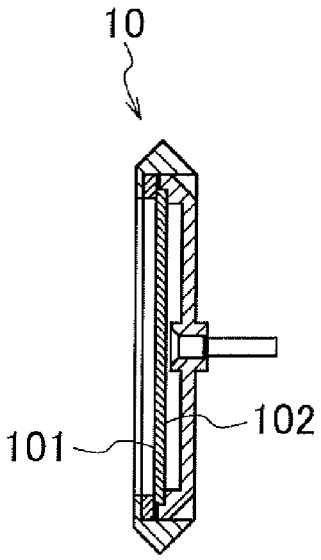
FIGS. 2A, 2B, and 2C are a plan view, a front view, and a cross-sectional view, respectively, of a condenser microphone unit included in the stereo microphone.
Figure 2A:
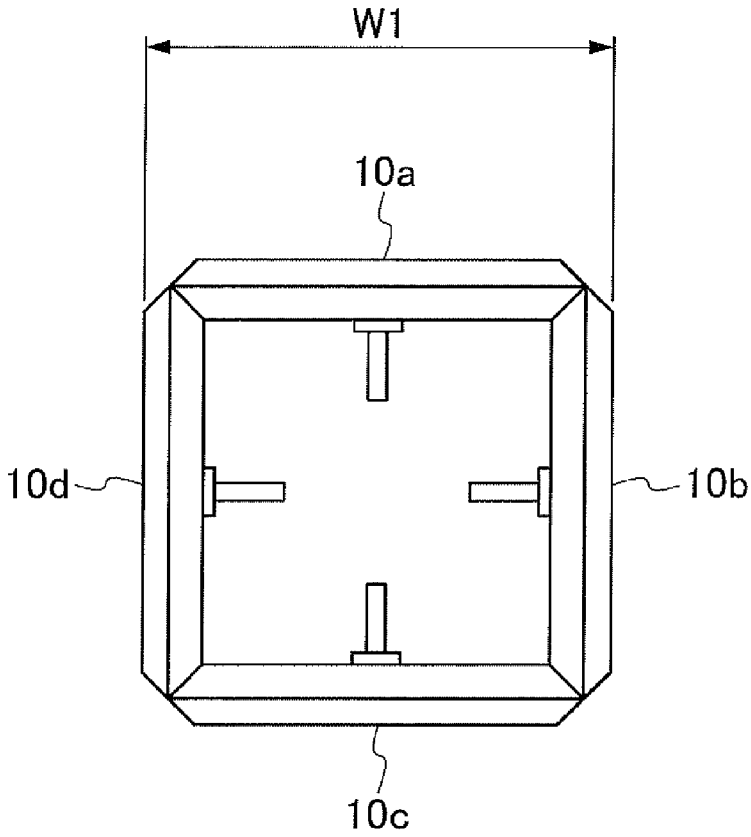
Figure 2B:
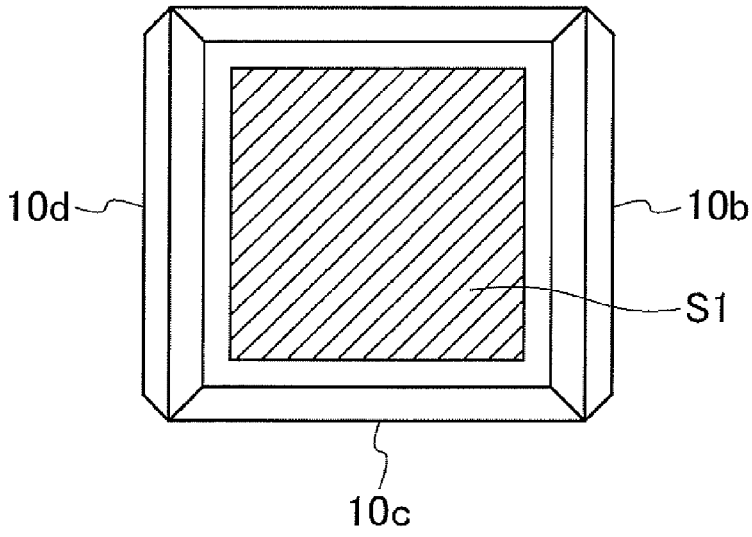

With reference to FIGS. 2A to 2C, four unidirectional condenser microphone units 10*a*, 10*b*, 10*c*, and 10*d* are disposed in the same horizontal plane such that peripheral portions thereof are in contact with each other by rotating directional axes of adjacent condenser microphone units 10 by 90°. The microphone units 10*a*, 10*b*, 10*c*, and 10*d* each have a square shape viewed from the front as described above and are common in size, electroacoustic transduction, and other specifications.

In the plan view of FIG. 2A, collaboration of the two diagonally-positioned condenser microphone units 10*a* and 10*c* or 10*b* and 10*d*, each having directional axes disposed at 180° to each other, provides a pair of bidirectional microphone units for right and left channels. The condenser microphone units 10*a* and 10*c* that serve as a pair of microphone units for the right channel are connected in series, while the condenser microphone units 10*b* and 10*d* that serve as a pair of microphone units for the left channel are connected in series. Thus, the two pairs of the microphone units provided as above are disposed having the directional axes at 90° to each other.

In the stereo microphone configured as above, a distance W1 between sound terminals of one pair of microphone units is defined by the length of the side of the substantially planar square of the condenser microphone unit 10 as the effective capacitance increases between a diaphragm 101 and a fixed electrode 102, the sensitivity increases while the effective noise decreases. In order to increase the effective capacitance, it is necessary to increase the area S1 of the diaphragm 101 of the condenser microphone unit 10.

In the following description, the area S1 of the diaphragm 101 in the embodiment is the same as the area S2 of the circular diaphragm 101 of the conventional condenser microphone unit 1 shown in FIGS. 4A to 4C.

With the area S1 of the diaphragm 101 in the embodiment same as the area S2 of the conventional circular diaphragm 101, the effective capacitance is also the same, thus similarly preventing generation of intrinsic noise.

In addition, the distance W1 between the sound terminals of the condenser microphone unit 10 in the embodiment can be shorter than the distance W2 between the sound terminals of the conventional stereo microphone. This is achieved with the square diaphragm 101 in the embodiment to eliminate an extra space S3 (refer to FIG. 4B) associated with the use of the circular diaphragm 101 in the conventional stereo microphone, thus increasing the volume ratio of the microphone unit in a predetermined volume space.

Figure 3:
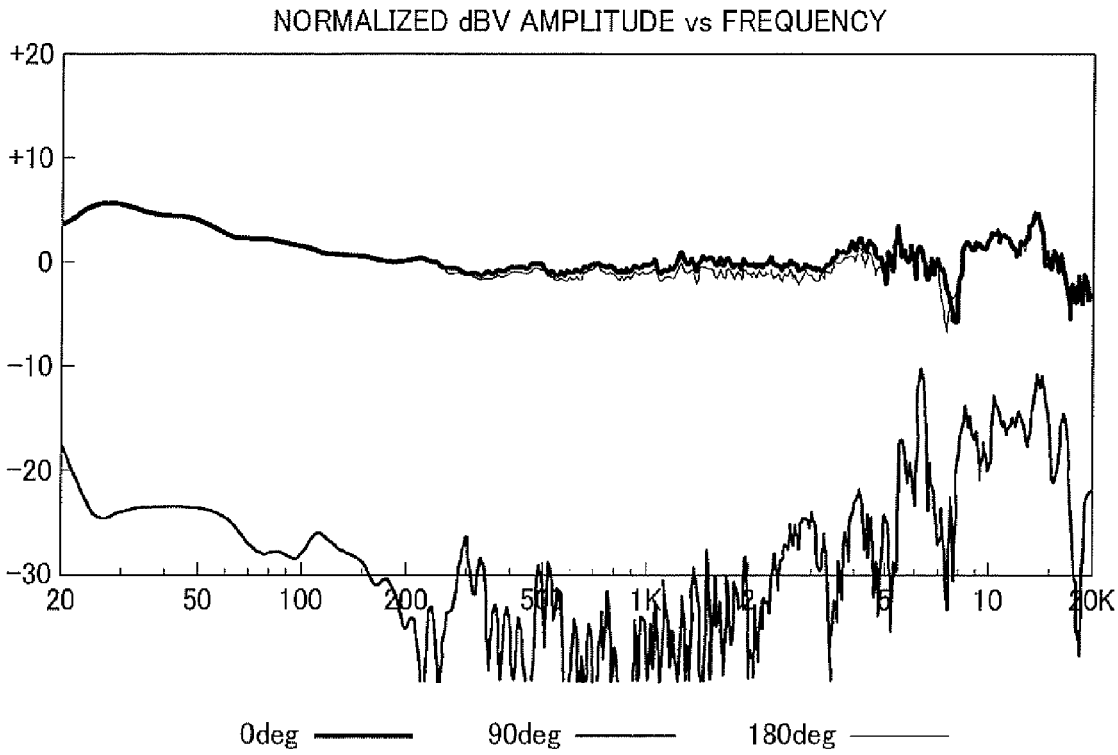
FIG. 3 is a graph illustrating the acoustic performance of the stereo microphone.
Figure 4C:
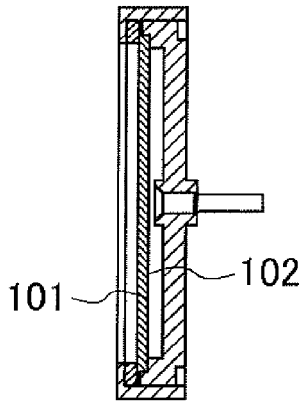
FIGS. 4A, 4B, and 4C are a plan view, a front view, and a cross-sectional view, respectively, of a condenser microphone unit included in a conventional stereo microphone.
Figure 4A:
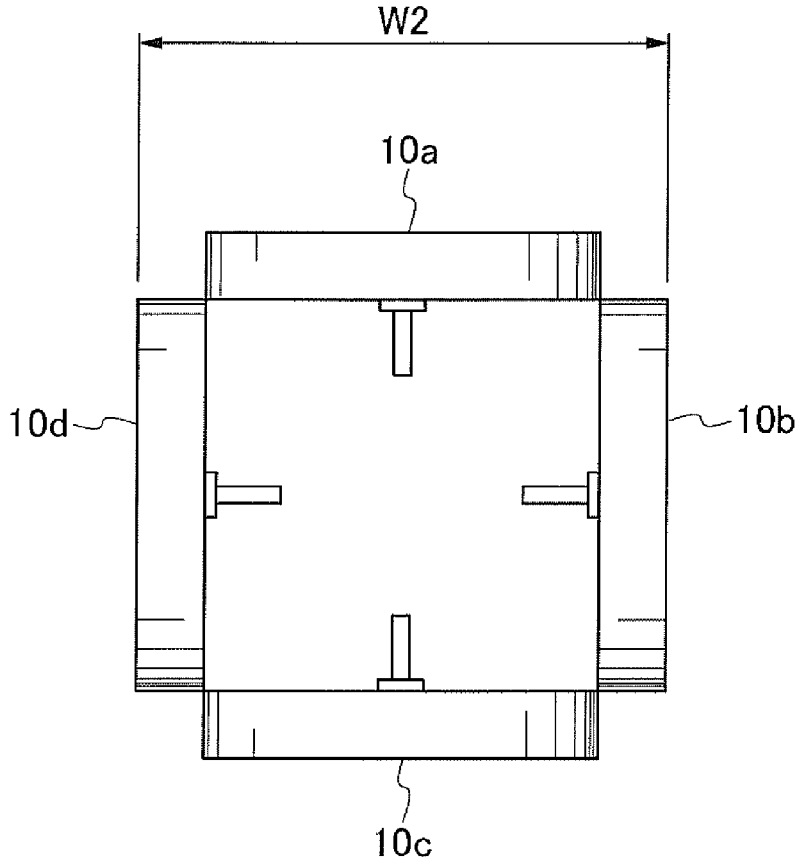
Figure 4B:
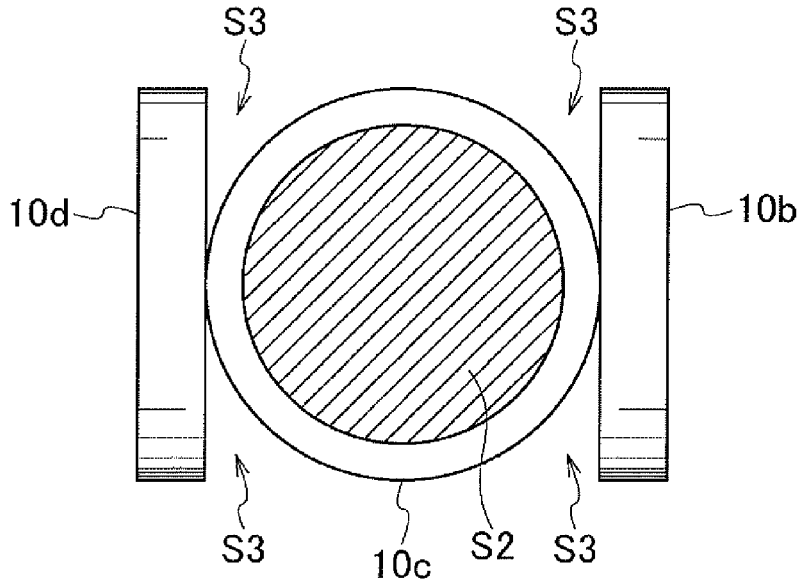
RELATED ART FIG. 4B
Figure 5:
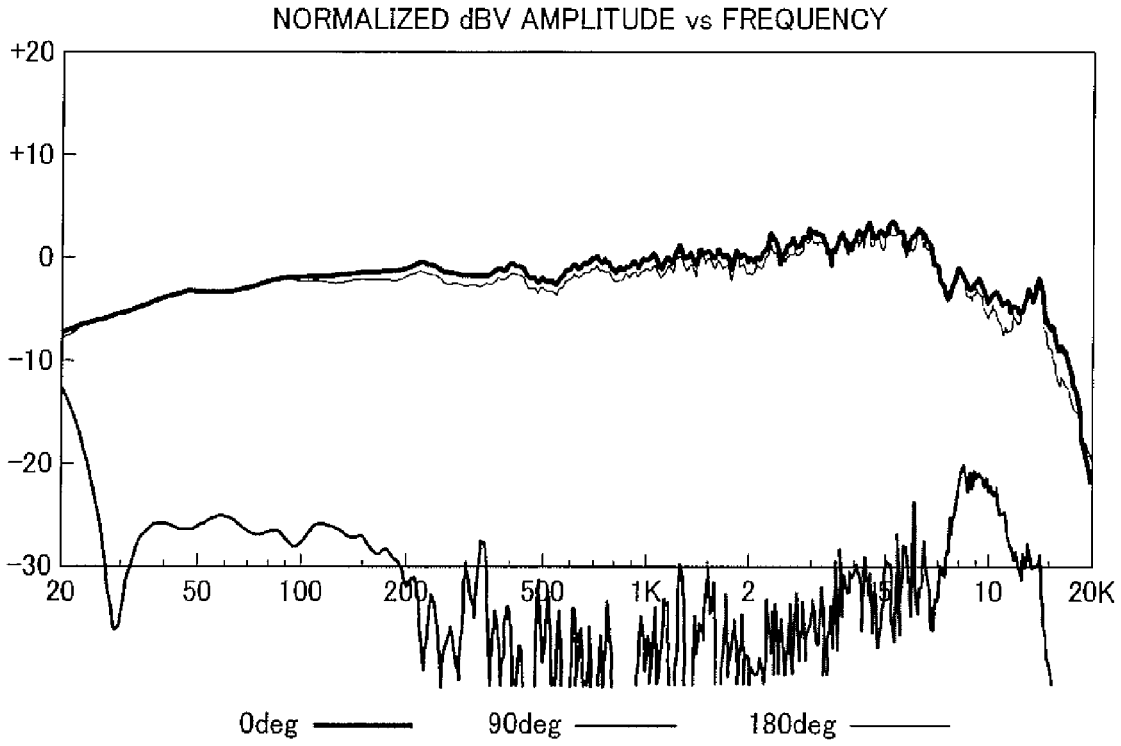
RELATED ART FIG. 5
FIG. 5 is a graph illustrating the acoustic performance of the conventional stereo microphone.

Thus, as shown in FIG. 3, the stereo microphone according to the present invention achieves stable directional frequency response in a high-frequency range, which is not achieved by the conventional stereo microphone (refer to FIG. 5).

The object of the present invention can be achieved by increasing the ratio of the microphone unit in a predetermined space. To this end, the planar shape of the microphone unit may be rectangular.

What is claimed is:

1. A stereo microphone comprising:

four condenser microphone units having directional axes, the directional axes being disposed in a single horizontal plane, the four condenser microphone units each having unidirectivity, the four condenser microphone units each having a quadrangular shape viewed from a direction of each directional axis, the four condenser microphone units being disposed such that adjacent condenser microphone units have directional axes directed in different directions by 90° to each other, wherein the four condenser microphone units are configured as a pair of bidirectional microphone units, each bidirectional microphone unit including two of the four condenser microphone units which have directional axes directed at 180° to each other and which collaborate with each other, wherein the four condenser microphone units are disposed such that peripheral portions thereof are in contact with each other, and wherein one of the bidirectional microphone units is for a right channel, and another of the bidirectional microphone units is for a left channel.

2. The stereo microphone according to claim 1, wherein the pair of bidirectional microphone units are disposed such that two directional axes of the pair are disposed at 90° to each other.

3. The stereo microphone according to claim 1, wherein the four condenser microphone units include a first unit, a second unit, a third unit, and a fourth unit, each of the four condenser microphone units has a first side and a second side opposite to each other, the first side of the peripheral portion of the first unit is in contact with the first side of the peripheral portion of the second unit, the second side of the peripheral portion of the first unit is in contact with the first side of the peripheral portion of the third unit, the second side of the peripheral portion of the second unit is in contact with the first side of the peripheral portion of the fourth unit, and the second side of the peripheral portion of the third unit is in contact with the second side of the peripheral portion of the fourth unit.

4. The stereo microphone according to claim 1, wherein each of the peripheral portions has a first side and a second side opposite to each other tilting from a direction of the peripheral portion and adjacent sides are in contact with each other.

* * * * *